US012318830B2

(12) United States Patent
Maillard et al.

(10) Patent No.: US 12,318,830 B2
(45) Date of Patent: Jun. 3, 2025

(54) MULTI-ROLL METAL STRIP LEVELER

(71) Applicant: CLECIM S.A.S., Savigneux (FR)

(72) Inventors: Sébastien Maillard, Vernaison (FR); Dominique Tellier, Saint Etienne (FR)

(73) Assignee: CLECIM S.A.S. (FR)

( * ) Notice: Subject to any disclaimer, the term of this patent is extended or adjusted under 35 U.S.C. 154(b) by 0 days.

(21) Appl. No.: 16/636,455

(22) PCT Filed: Jul. 17, 2018

(86) PCT No.: PCT/EP2018/069394
§ 371 (c)(1),
(2) Date: Feb. 4, 2020

(87) PCT Pub. No.: WO2019/025179
PCT Pub. Date: Feb. 7, 2019

(65) Prior Publication Data

US 2020/0171559 A1 Jun. 4, 2020

(30) Foreign Application Priority Data

Aug. 4, 2017 (EP) ..... 17290100

(51) Int. Cl.
*B21D 1/02* (2006.01)
*B21D 1/06* (2006.01)
(Continued)

(52) U.S. Cl.
CPC ..... *B21D 1/02* (2013.01); *B21D 1/06* (2013.01); *B21D 1/12* (2013.01); *B21D 3/02* (2013.01)

(58) Field of Classification Search
CPC ... B21D 1/00; B21D 1/02; B21D 1/05; B21D 1/06; B21D 1/12; B21D 3/00; B21D 3/02; B21D 3/05
See application file for complete search history.

(56) References Cited

U.S. PATENT DOCUMENTS 4,286,452 A * 9/1981 Schneider ..... B21D 3/05 72/164
4,457,149 A * 7/1984 Weinzinger ..... B21C 19/00 72/10
(Continued)

FOREIGN PATENT DOCUMENTS

CN 101579707 A 11/2009
CN 102548681 A 7/2012
(Continued)

OTHER PUBLICATIONS

International Search Report mailed Oct. 15, 2018 in corresponding PCT International Application No. PCT/EP2018/069394.
(Continued)

*Primary Examiner* — Christopher L Templeton
*Assistant Examiner* — Matthew Stephens
(74) *Attorney, Agent, or Firm* — OSTROLENK FABER LLP

(57) ABSTRACT

A metal strip leveler (B): the strip has a thickness (e) subject to a stress distribution. The leveler includes a row of upper rolls (1, 3, 5, 7, 9 . . . ) and a row of lower rolls (2, 4, 6, 8, 10 . . . ) having parallel axes, are longitudinally offset in a direction of line of passage (lp) and are offset in height, to define, by vertical imbrication (overlapping) of the rolls, an undulating path of the strip between the rolls. The imbrication occurs because the rows of rolls are interleaved partially to create an undulating path for the strip. At least two upper rolls ([1, 3]; [5, 7]) and two lower rolls ([2, 4]; [6, 8]) are arranged respectively above and below the line of passage, such that they form three vertical imbrication gaps. Those gaps have a profile of non-linear imbrication values (Imbr) that are either convex or concave with respect to a profile of linear imbrication values (Imbr_lin) in the direction of the line of passage.

14 Claims, 2 Drawing Sheets

(51) Int. Cl.
*B21D 1/12* (2006.01)
*B21D 3/02* (2006.01)

(56) References Cited

U.S. PATENT DOCUMENTS

| | | | | | |
|---|---|---|---|---|---|
| 4,635,458 | A * | 1/1987 | Bradlee | B21D 1/02 | 72/163 |
| 8,291,738 | B2 | 10/2012 | Noe | | |
| 8,485,010 | B1 * | 7/2013 | Francis | F23G 7/08 | 72/31.03 |
| 9,387,526 | B2 | 7/2016 | Abe | | |
| 9,604,270 | B2 | 3/2017 | Noe | 72/6.2 | |
| 2004/0069035 | A1 * | 4/2004 | Bourgon | B21D 1/02 | 72/160 |
| 2004/0089044 | A1 * | 5/2004 | Tondo | B21D 1/05 | 72/160 |
| 2015/0251235 | A1 * | 9/2015 | Smith | B21B 37/46 | 72/14.4 |
| 2016/0001339 | A1 * | 1/2016 | Magnani | B21D 1/02 | 72/160 |

FOREIGN PATENT DOCUMENTS

| | | | | |
|---|---|---|---|---|
| CN | 103372585 | A | 10/2013 | |
| CN | 104668313 | A | 6/2015 | |
| CN | 106825120 | A * | 6/2017 | B21D 1/02 |
| EP | 0 665 069 | A1 | 8/1995 | |
| EP | 2 813 299 | A1 | 12/2014 | |
| FR | 2 334 440 | A1 | 7/1977 | |
| JP | S63-114821 | A | 5/1988 | |
| JP | S63-144821 | A | 6/1988 | |
| JP | H08-174065 | A | 7/1996 | |
| JP | 2006-122963 | A | 5/2006 | |
| JP | 2008-174065 | A | 7/2008 | |
| JP | 2013-215754 | A | 10/2013 | |
| JP | 5448692 | B2 | 3/2014 | |
| KR | 10-2003-0064788 | A | 8/2003 | |
| KR | 20120097178 | A * | 9/2012 | B21D 1/02 |
| KR | 10-2014-0145998 | A | 12/2014 | |
| WO | WO2018167029 | A1 * | 9/2018 | B21D 1/02 |

OTHER PUBLICATIONS

Written Opinion mailed Oct. 15, 2018 in corresponding PCT International Application No. PCT/EP2018/069394.

European Search Report mailed Mar. 16, 2018 in corresponding European Patent Application No. 17290100.1.

Directorate-General for Research and Innovation (European Commission): "The mechanical and metallurgical effects of skin passing and tension levelling;" European Commission Technical Steel Research; XP002778615; 1992.

Chinese Office Action, dated Jan. 6, 2021, issued in Chinese Patent Application No. 201880050817.6. English translation. Total 13 pages.

Patent family search for JP2008-174065A, Derwent Data © Clarivate Analytics, Derwent Abstract Accession No. 2008-J89656.

Patent family search for KR 10-2014-0145998 A, Derwent Data © Clarivate Analytics, Derwent Abstract Accession No. 2014-R40126.

Patent family search for JP5448692B2, Derwent Data © Clarivate Analytics, Derwent Abstract Accession No. 2011-E24072.

Patent family search for KR 10-2003-0064788 A, Derwent Data © Clarivate Analytics, Derwent Abstract Accession No. 2002-405703.

* cited by examiner

MULTI-ROLL METAL STRIP LEVELER

CROSS-REFERENCE TO RELATED APPLICATIONS

The present application is a 35 U.S.C. §§ 371 national phase conversion of PCT/EP2018/069394, filed Jul. 17, 2018, the contents of which are incorporated herein by reference, which claims priority of European Patent Application No. 17290100.1, filed Aug. 4, 2017, the contents of which are incorporated by reference herein. The PCT International Application was published in the French language.

BACKGROUND OF THE INVENTION

The present invention relates to a metal strip leveler.

Metal strips such as sheet metal, used in particular in automobile applications, are currently being developed to have very advanced mechanical properties. For example, developments use thermal treatment systems that cause a phase transformation in difficult-to-control conditions (for example during rapid cooling) and that cause deformations, variations and internal stresses with the metal product.

Final shaping of the metal products, for example by stamping or forming, is therefore made more difficult by the high-yield properties (springback) and requires use of an incoming product made of uniform material that is free of internal stresses.

It is known that a metal strip leveler corrects flatness defects. For example, the leveler uses two rows of rolls, respectively upper leveling rolls and lower leveling rolls, in which the axes of the upper and lower rolls are parallel, offset longitudinally in a pass-line direction of the strip, and offset in height, in order to form an undulating path between the rolls by penetration of rolls, called imbrication. Principally, this type of leveler is able to elongate the strip strands to make the strip flatter. An anti-curling machine may be arranged at the exit of such a leveler to correct any residual deformation related to the strip curling effect.

The leveler has a second multi-roll module at the exit that is primarily intended to reduce the residual stresses in the metal strip.

An essential prior art document EP0665069A1, filed by the applicant hereof, discloses such a leveler optimized to improve reduction of flatness defects and residual stresses, using the aforementioned features and advantages.

A study entitled "The mechanical and metallurgical effects of skin passing and tension levelling", European Commission, ISSN 1018-5593, Technical Steel Research, 1992, § 2.3.3.3, § 2.3.3.4, FIGS. 20-23 in particular, sets out tension leveling profiles including a first profile of linear penetration values of the rolls (penetration settings of rollers (mm), FIG. 22) in the pass-line direction that form a "wedge" effect, i.e. in which the penetration is greater at the entry of the leveler than at the exit thereof, linearly and in order to compensate residual stresses of the product under tension. Finally, a second profile of linear penetration values of the rolls is also provided, including two discontinuous successive linear profiles of linear penetration values (penetration settings of rollers (mm), (FIG. 23) in the pass-line direction. This improved profile is achieved by arranging two successive sets of leveling cassettes (upper and lower), each of which can be individually inclined in a plane vertical to the strip pass-line. It is specified that such penetration value profiles compensate the linear residual stresses in the material, but that non-linear stresses appear to persist. Equally, a recent publication EP2813299A1 discusses the same principle of a tension leveler, and therefore also has these same drawbacks, in addition to the drawbacks set out below.

The applicant is further studying non-linear residual stresses. On-site and simulated experiments have demonstrated that, after tension leveling as described in the aforementioned prior art, the metal strip mainly has mechanical stresses with very asymmetrical intensity through the thickness of the product and in relation to at least one neutral axis of the strip. Indeed, as in the prior art mentioned by the European Commission study ISSN 1018-5593 or EP2813299A1, and having tested the continuous or discontinuous linear penetration profiles, in which several inclinations are possible, these residual stresses, hereinafter referred to as asymmetrical, persist, and have a negative effect on the required quality of the leveled product.

In this regard, two Figures are provided:

FIG. 1 shows an asymmetrical profile of residual stresses as a function of the thickness of the strip, such as after a leveling stage according to the prior art, FIG. 2 shows an optimized residual stress profile proposed by the invention.

FIG. 1 shows a typical example of an asymmetrical profile of residual stresses (c) as a function of the thickness (e) of the strip (B), such as occurs after a leveling stage according to the prior art. The stress value is zero along at least one neutral axis (fn). The neutral axis in this case is set apart from a "strip center" axis (cb) located in the middle of the thickness of the strip. This provides a typical example of asymmetry in non-linear residual stress (c) profiles since, in the thickness domain beneath the neutral axis offset from the strip center, low negative stresses (=compression) are recorded, while in the thickness domain above the neutral axis offset from the strip center, high non-linear positive stresses (=traction) are present. This asymmetrical distribution imbalance of non-linear stresses obviously has a very negative effect on subsequent forming stages that require controlled stress properties (established symmetry) as a function of strip thickness.

FIG. 2 shows an optimized residual stress profile proposed by the invention, in which the asymmetry of the profile in FIG. 1 tends to be corrected by a balancing of the positive and negative asymmetrical stresses. Such balancing should result in a stress profile that is symmetrical in relation to the strip center, in which the distribution of positive and negative stresses (c) is also as balanced as possible.

BRIEF DESCRIPTION OF THE INVENTION

One purpose of the present invention is to propose a metal strip leveler that is at least able to compensate an imbalance, in particular an asymmetrical imbalance, in the distribution of residual stresses through the thickness of the leveled strip, in particular for high-yield steels.

The invention comprises a metal strip leveler. The strip has a thickness subject to a stress profile. The profile has at least one flatness defect and/or an asymmetry as a function of the thickness of the product. The leveler includes:

- a row of upper rolls and a row of lower rolls, wherein the rolls are leveling or straightening rolls in contact with the strip,
- the axes of the upper and lower rolls are parallel, longitudinally offset in a pass-line direction of the strip and offset in height, the strip forms an undulating path of the strip between the rolls by means of the vertical penetration or imbrication of the rolls for causing vertical undulations of the strip, at least two upper rolls and two lower rolls are arranged respectively above and below the pass line to form three vertical penetration gaps. The gaps have at least one non-linear penetration value profile that is either convex or concave with respect to a profile of linear penetration values along the pass-line direction, e.g.: convex has the profile rising and then descending, concave has the pass line descending and then rising.

A major advantage of a penetration profile with at least three non-linear gaps along the pass direction line is that the residual stresses are better distributed through the thickness of the leveled strip, according to the model in FIG. 2. Appropriately setting the vertical penetration by adjusting the penetration of the rolls enables balancing of asymmetrical stresses. This is unlike known linear profiles, which mostly only have a leveling effect that absorbs symmetrical stresses through the thickness of the strip to be leveled, and therefore cannot balance an asymmetrical stress.

Several advantageous embodiments of the leveler according to the invention are therefore possible, as a function of qualitative requirements.

BRIEF DESCRIPTION OF THE DRAWINGS

Example embodiments and applications are provided using the figures described.

DESCRIPTION OF EMBODIMENTS

Figure 1:
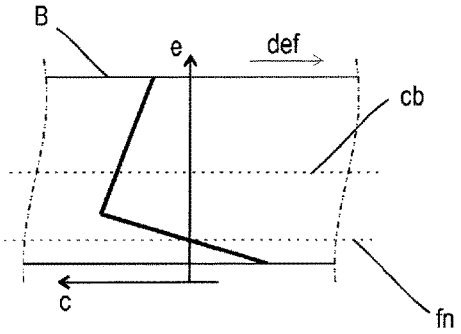
FIG 1 PRIOR ART
FIG. 1 shows an asymmetrical profile of residual stresses as a function of the thickness of the strip, shown in the prior art.
Figure 2:
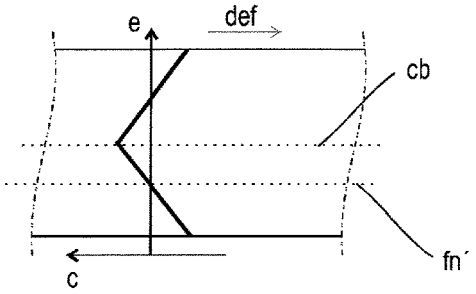
FIG. 2 shows an optimized residual profile proposed by the invention.
Figure 3:
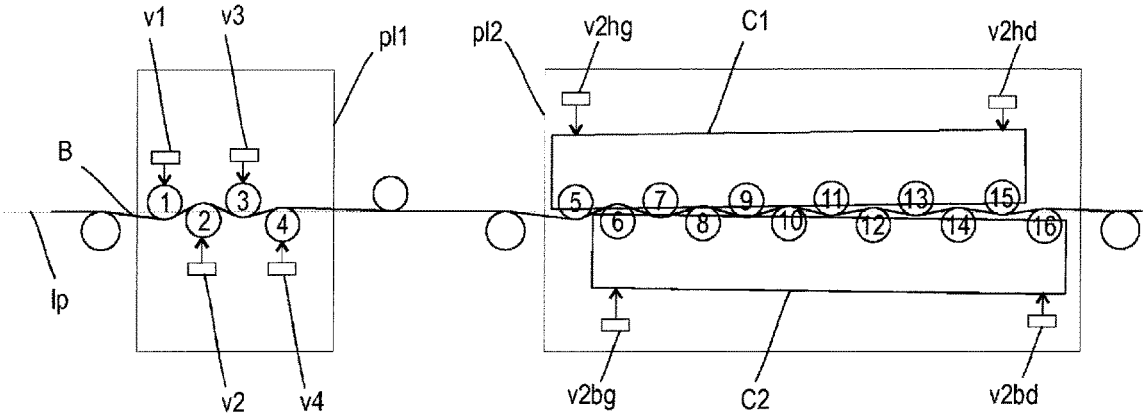
FIG. 3 illustrates a first embodiment of the leveler according to the invention.

FIG. 3 is a side view (operator side, for example) of a first embodiment of the leveler of a metal strip (B) according to the invention. The thickness of the strip is subjected to a stress profile as described above in relation to FIG. 1. The strip can also have flatness defects of any type.

The leveler includes:

a row of upper rolls (1, 3, 5, 7, 9, . . . ) and a row of lower rolls (2, 4, 6, 8, 10, . . . ),. The rolls are leveling or straightening rolls in contact with the strip;

the axes of the upper rolls are parallel and the axes of the lower rolls are also parallel. The axes are longitudinally offset in a pass-line direction (lp). Neighboring axes are offset in height. Neighboring rolls thereby form an undulating path of the strip between the rolls by means of the vertical penetration or imbrication of the rolls. The height offsets will produce either convex or concave profiles of penetration values along the pass line direction, at least two upper rolls (1, 3) and two lower rolls (2, 4) are arranged respectively above and below the pass line and are positioned to form at least three vertical penetration gaps. Those gaps in FIG. 3 have a profile of non-linear penetration values that is described in greater detail by FIG. 4.

Figure 4:
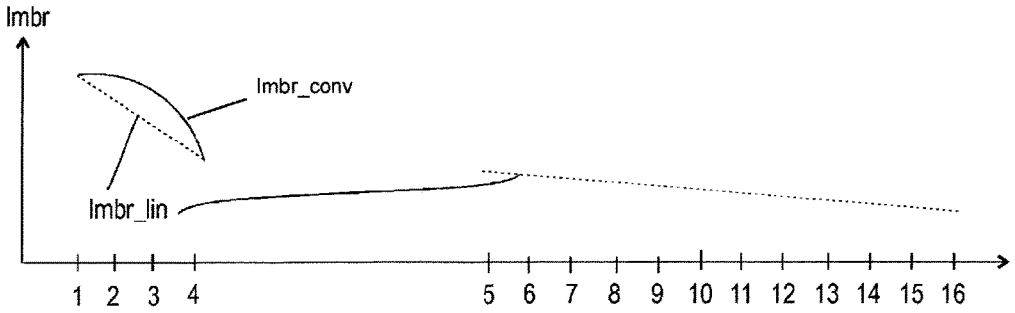
FIG. 4 illustrates a penetration profile according to FIG. 3.

With reference to FIG. 3, FIG. 4 shows the gaps with a profile (unbroken line) of non-linear penetration values (Imbr_conv) (Imbr) for the rolls (1, 2, 3, 4) that is convex or concave in relation to a profile (dotted line) of linear penetration values (Imbr_lin) in the pass-line direction (e.g. rolls 1 to 16 in this case).

In FIGS. 3 and 4, and according to the first embodiment of the leveler according to the invention, the two upper rolls and the two lower rolls (1, 2, 3, 4) are arranged in a first leveling assembly (pl1) incorporating, for each of the rolls, individual vertical adjustment (v1, v2, v3, v4) in relation to a frame, a beam, a cassette or any other holding element included in the leveler for this purpose. Ideally, the adjustment of at least one of the rolls may be performed by at least one jack.

The first rolls of the leveler in the first leveling assembly (pl1) in principle perform most of the elongation of the strip to correct flatness defects and stresses.

The leveler can also include at least one second leveling assembly (pl2) formed respectively by an upper cassette (C1) and a lower cassette (C2) of a multi-roll leveler (5, 6, 7, 8, . . . ). This layout is particularly suited to leveling "tin plate" steel, which is for example suited to manufacturing metal packaging.

In FIGS. 3 and 4, only the non-linear gaps for obtaining the convex (or concave) penetration profile are formed by penetration of the rolls of the first leveling assembly (pl1), thereby enabling compensation of the asymmetrical stress imbalances.

Usually, at least one of the cassettes (C1, C2) of the second leveling assembly (pl2) is inclined using vertical displacement means (v2*hg*, v2*hd*, v2*bg*, v2*bd*), so that the cassettes are arranged at an open angle in a vertical plane in the pass direction. This enables the penetration of the rolls to be progressively and linearly reduced in the case of both of FIGS. 3 and 4 or as in the prior art, thereby helping to reduce stresses in the strip, but with the exception of asymmetrical stresses.

Figure 5:
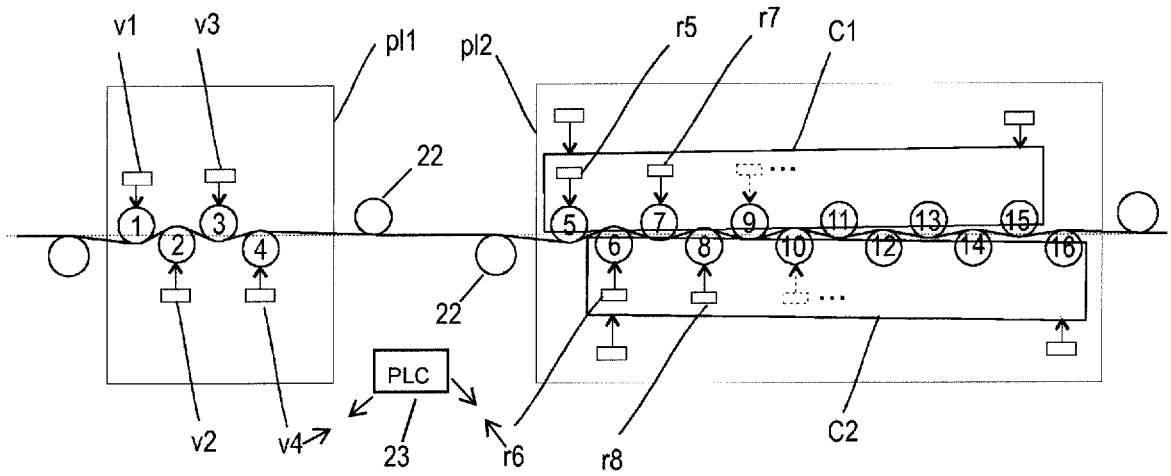
FIG. 5 illustrates second and third embodiments of the leveler according to the invention.
Figure 6:
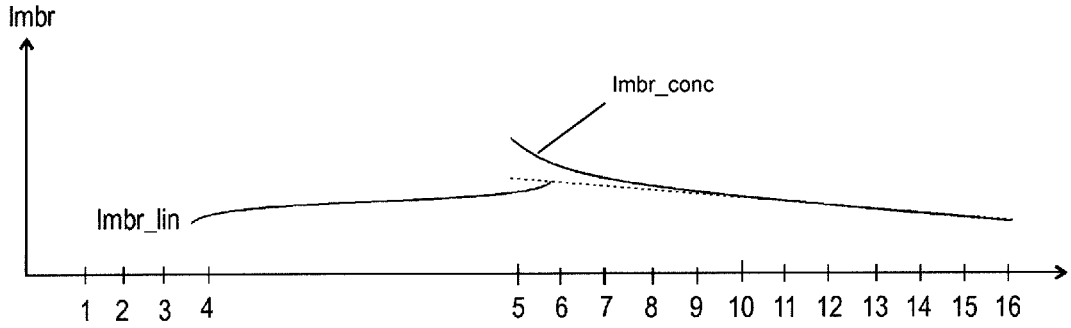
FIG. 6 illustrates a penetration profile according to the second embodiment.
Figure 7:
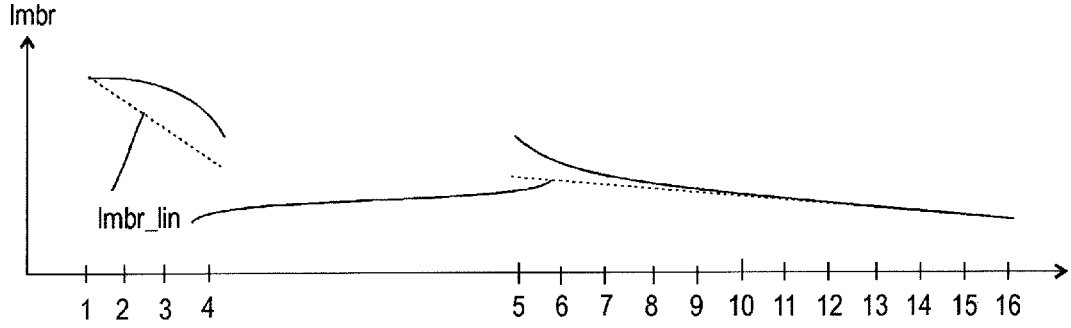
FIG. 7 illustrates a penetration profile according to the third embodiment.

FIGS. 5 to 7 show second and third embodiments of the leveler according to the invention.

In the second embodiment of the leveler according to the invention, as shown in FIG. 5, the leveler includes only the second multi-roll leveling assembly (wherein the first leveling assembly is absent or in this Figure, inactive). This type of multi-roll leveler usually has a high number of rolls (15 or more) and has the advantage of being able to reduce major flatness defects and stresses.

In this case, the profile of non-linear penetration values is applied to at least four rolls of the second leveling assembly (pl2), for example using two upper rolls (5, 7) and the two lower rolls (6, 8), which are arranged in (at least) the second leveling assembly (pl2) respectively formed by an upper cassette (C1) and a lower cassette (C2) of a multi-roll leveler. At least one of the cassettes incorporates, for each of the rolls, individual vertical adjustment (r5, r7; r6, r8, . . . ) for the rolls in relation to the cassettes, in which the adjustment ideally includes a mechanical actuator or servomotor.

FIG. 6 shows an example profile (Imbr_conc) of non-linear penetration values (Imbr), in this case concave, which is applied only to the rolls (5, 6, 7, 8, etc.) of the second leveling assembly (pl2) shown in FIG. 5 for this second embodiment. The first leveling assembly, as in FIG. 5, is absent or inactive.

Finally, in the third embodiment of the leveler according to the invention, shown in FIG. 5, the leveler again includes the first and second leveling assemblies (pl1, pl2). For this purpose, at least the two upper rolls and the two lower rolls linked to the profile of non-linear penetration values are distributed or split between the first assembly and the second assembly. For example, it is possible to generate a profile of non-linear penetration values for the four rolls (1, 2, 3, 4) in the first leveling assembly (pl1) and for one, two, three, four or more of the rolls (5, 6, 7, 8, . . . ) in the second leveling assembly (pl2).

This example of two profiles (Imbr) arranged in succession along the pass line is shown in FIG. 7 in the form of a first convex profile for the rolls (1, 2, 3, 4) followed by a second concave profile for the rolls (5, 6, 7, 8, etc.) respectively in relation to each of the two successive linear penetration profiles (Imbr_lin) usual in the prior art.

In the prior art, the rolls of the second leveling assembly (pl2) make it possible to limit the residual stresses generated by decreasing linear leveling penetration to compensate the stresses induced in the product. The application of profiles of non-linear penetration values (convex and/or concave) according to FIG. 5 about the linear profiles helps to very advantageously additionally compensate stress asymmetries in the thickness of the product. By applying the profile of non-linear penetration values to the rolls of the second leveling assembly (pl2) in addition to the rolls of the first leveling assembly (pl1), it is possible to further reduce the asymmetrical stresses and there is an advantageous option of using at least one, two, three or more of the first rolls in the second leveling assembly (pl2) to accentuate (second embodiment) or continue (third embodiment) an elongation operation for the strip having characteristics that prevent the first leveling assembly (pl1) from effecting sufficient elongation. To do this, the first rolls (in the strip pass direction) of the second leveling assembly (pl2) are arranged using non-linear penetration values in a concave or a convex manner. The non-linear penetration values are greater than the linear penetration values (Imbr_lin). Such an advantageous profile of non-linear penetration values is shown explicitly in FIGS. 6 and 7.

For all of the embodiments shown in FIGS. 3 to 7, an existing leveler can also be adapted easily and cheaply to provide the characteristics and advantages of the leveler according to the invention, given that:

- the vertical displacement means (v1, v2, v3, v4) of the first leveling assembly (pl1) are present in an existing leveler including the first assembly,
- vertical displacement means (r5, r6, r7, r8 . . . ) can be provided or inserted into the existing cassettes of the second leveling assembly (pl2).

Finally, and equally for all of the embodiments disclosed FIGS. 3 to 7), the leveler according to the invention has the following characteristics and advantages:

- the second multi-roll leveling assembly (pl2) has several pairs of upper and lower cassettes arranged in succession along the pass line in order to generate greater elongation effects (leveling) in a first pair of cassettes and to generate lesser elongation effects (straightening) in a second pair of cassettes. All of these pairs of cassettes enable the range of non-linear penetration values to be modulated and expanded for very asymmetrical stresses,
- the profile of linear penetration values (Imbr_lin) in the pass-line direction decreases from an entry to an exit of at least one strip leveling portion along the pass line, and the profile of non-linear penetration values approaches or intersects the profile of linear penetration values such that the reducing effect of residual stresses (excluding asymmetrical stresses reduced by the invention) is always retained,
- At least two tensioners 22 are arranged upstream and downstream respectively of at least one group of upper and lower rolls, such that the strip is subjected to a tensile stress;
- setting the second embodiment aside, the second leveling assembly (pl2) includes at least 2.2 times as many rolls as the first leveling assembly (pl1), ideally between 2.5 and 6 times as many, such that if a more intense leveling (hard steel, with very high yield strength), within the meaning of the invention, is required, it may not be necessary to increase the number of rolls in the first leveling assembly (pl1) if that assembly is present or active, but rather to increase the number of rolls in the second leveling assembly (pl2), and in particular the number of rolls (5, 6, 7, 8, . . . ) with a profile of non-linear penetration values during cassette maintenance or swapping,
- embodiments of the leveler according to the invention can advantageously be controlled by a PLC control unit 23 and/or by an operator, in which that unit has a data medium containing different stress profile models as a function of the mechanical properties of different materials of the strip to be leveled, and that is able to select one of the related leveling models providing different profiles of non-linear penetration values in the form of control signals sent to the vertical adjustment actuators (v1, v2, . . . ; r5, r6, . . . ) of the successive leveling rolls. This enables manufacturers of leveled products to more easily extend product ranges while guaranteeing high product quality, in particular as a result of advantageously compensated asymmetrical stresses;
- Finally and advantageously, in the embodiments of the leveler according to the invention, as illustrated in the Figures, at least three vertical gaps between the first pairs of successive upper and lower rolls have a first profile of non-linear penetration values on the operator side and at least three vertical gaps between the second pairs of successive upper and lower rolls have a second profile of non-linear penetration values different from the first profile on the motor side, in which the first and second pairs of rolls are attached to the same rolls or are made up of different rolls. This dual profile of non-linear penetration values very advantageously enables compensation of divergent asymmetries of transverse stresses in the product.

The invention claimed is:

1. A metal strip leveler configured to balance positive and negative stresses in a metal strip having an asymmetrical stress profile that is asymmetrical along its thickness with a neutral axis offset from the metal strip's center, and unbalanced negative and positive stresses above and below the neutral axis, the leveler comprising:

at least one leveling assembly that includes, a row of upper rolls and a row of lower rolls that are arranged successively to define an undulating path for the passage of the metal strip in a pass-line direction along a pass line;

each of the upper and the lower rolls has a longitudinal axis that is parallel, offset along the pass-line direction, and offset in height relative to each longitudinal axis of each of the other rolls, the upper and lower rolls are imbricated to define the undulating path by vertical penetration of the rolls into the pass-line;

a programmable computer; and a vertical adjustment actuator associated with each roll of the successively arranged rolls;

wherein the longitudinal axes of at least two of the upper rolls and the longitudinal axes of two of the lower rolls are respectively above and below the pass-line, and wherein there are at least four successive vertical penetration gaps into the pass-line each associated with a respective imbrication value to obtain, in order, a first imbrication value, a second imbrication value, a third imbrication value, and a fourth imbrication value, each of the four successive imbrication values is different from the other three of the four successive imbrication values, the first imbrication value and the second imbrication value are different by a first difference value, the second imbrication value and the third imbrication value are different by a second difference value different than the first difference value, and the third imbrication value and the fourth imbrication value are different by a third difference value different than the first difference value and the second difference value, whereby the four successive imbrication values vary non-linearly to define a non-linear penetration profile representing vertical penetration of the rolls into the pass-line, the non-linear penetration profile being curved relative to a profile of linear imbrication values, and the non-linear penetration profile varying non-linearly along the pass-line direction from the first roll to the last roll in the successively arranged rolls of the at least one leveling assembly, and wherein the programmable computer has a data medium containing different stress profile models as a function of the mechanical properties of different materials of the strip to be leveled, and the programmable computer is configured to send control signals to the vertical adjustment actuators based on the leveling models to set the first imbrication value, the second imbrication value, the third imbrication value, and the fourth imbrication value to define the non-linear penetration profile in order to correct the asymmetrical stress profile by moving the neutral axis toward the metal strip's center, and balance the negative and positive stresses above and below the neutral axis.

2. The leveler as claimed in claim 1, wherein each of the two upper rolls and the two lower rolls is adjustable in the thickness directions of the strip.

3. The leveler as claimed in claim 2, further comprising a second leveling assembly that includes 2.2 times as many rolls as the at least one leveling assembly.

4. The leveler as claimed in claim 2, further comprising a second leveling assembly that includes between 2.5 and 6 times as many rolls as the first leveling assembly.

5. The leveler as claimed in claim 1, further comprising a first leveling assembly, and at least one second leveling assembly, wherein the two upper rolls and the two lower rolls of the at least one leveling assembly are arranged in the at least one second leveling assembly, the at least one second leveling assembly comprises an upper cassette and a lower cassette of a multi-roll leveler, in which the upper rolls are in the upper cassette and the lower rolls are in the lower cassette;

at least one of the upper and lower cassettes incorporates, for each of the rolls thereof, an individual vertical adjustment element for adjusting each roll in relation to the respective cassettes, in which the adjustment element includes a mechanical actuator or servomotor.

6. The leveler as claimed in claim 1, further comprising a second leveling assembly that comprises upper rolls, and lower rolls, the upper rolls and the lower rolls of the at least one leveling assembly and the second leveling assembly being split between the at least one leveling assembly and the second leveling assembly.

7. The leveler as claimed in claim 6, further comprising the first rolls of the second leveling assembly are arranged using non-linear penetration values in a concave or a convex manner, the non-linear penetration values being greater than the linear penetration values.

8. The leveler as claimed in claim 7, further comprising the second leveling assembly has several pairs of upper and lower cassettes arranged in succession along the pass line direction.

9. The leveler as claimed in claim 1, further comprising the profile of linear penetration values in the pass-line direction decreases from an entry toward an exit of at least one strip leveling portion along the pass line.

10. The leveler as claimed in claim 1, further comprising at least two tensioners are arranged upstream and downstream respectively of at least one group of upper and lower rolls, for subjecting the strip to a tensile stress.

11. The leveler as claimed in claim 1, wherein the programmable computer is a PLC control unit.

12. The leveler as claimed in claim 1, wherein the at least three vertical gaps between the first pairs of successive upper and lower rolls have a first profile of non-linear penetration values on an operator side and at least three vertical gaps between the second pairs of successive upper and lower rolls have a second profile of non-linear penetration values different from the first profile on the motor side, in which the first and second pairs of rolls made up of different rolls.

13. The leveler as claimed in claim 1, wherein the curved line is convex or concave.

14. A method of leveling a metal strip with a metal strip leveler configured to balance positive and negative stresses in the metal strip having an asymmetrical stress profile that is asymmetrical along its thickness with a neutral axis offset from the metal strip's center, and unbalanced negative and positive stresses above and below the neutral axis, the metal strip leveler comprising:

at least one leveling assembly that includes a row of upper rolls and a row of lower rolls that are arranged successively along a pass line, each of the upper and the lower rolls having a longitudinal axis that is parallel, offset along a pass-line direction, and offset in height relative to each longitudinal axis of each of the other rolls, the method comprising:

imbricating the upper and lower rolls to define an undulating path for the passage of the metal strip in the pass-line direction along the pass line by vertical penetration of the rolls into the pass-line, wherein the longitudinal axes of at least two of the upper rolls and the longitudinal axes of two of the lower rolls are respectively above and below the pass-line, and wherein there are at least four successive vertical penetration gaps into the pass-line;

correcting the asymmetrical stress profile by moving the neutral axis toward the metal strip's center, and balancing the negative and positive stresses above and below the neutral axis by setting each of the four successive vertical penetration gaps to obtain, in order, a first imbrication value, a second imbrication value, a third imbrication value, and a fourth imbrication value, each of the four imbrication values being different from the other three of the four successive vertical penetration values, the first imbrication value and the second imbrication value being different by a first difference value, the second imbrication value and the third imbrication value being different by a second difference value different than the first difference value, and the third imbrication value and the fourth imbrication value being different by a third difference value different than the first difference value and the second difference value to define a profile of non-linear imbrication values that vary non-linearly to define a non-linear penetration profile representing vertical penetration of the rolls into the pass-line, the non-linear penetration profile being curved relative to a profile of linear imbrication values, and the non-linear penetration profile varying non-linearly along the pass-line direction from the first roll to the last roll in the successively arranged rolls of the at least one leveling assembly; and leveling the metal strip with the metal strip leveler.

* * * * *